US005954602A

United States Patent [19]

Eggiman et al.

[11] Patent Number: 5,954,602

[45] Date of Patent: Sep. 21, 1999

[54] BAT END PLUG AND METHOD FOR MAKING THE SAME

[75] Inventors: Michael D. Eggiman, Hillsboro; Mark A. Fritzke, Portland, both of Oreg.

[73] Assignee: DeMarini Sports, Inc., Hillsboro, Oreg.

[21] Appl. No.: 09/165,474

[22] Filed: Oct. 2, 1998

[51] Int. Cl.[6] ..... A63B 59/06

[52] U.S. Cl. ..... 473/566

[58] Field of Search ..... 473/566, 567, 473/564, 457

[56] References Cited

U.S. PATENT DOCUMENTS

| | | |
|---|---|---|
| 1,499,128 | 6/1924 | Shroyer . |
| 1,611,858 | 12/1926 | Middlekauff . |
| 3,116,926 | 1/1964 | Owen et al. . |
| 3,727,295 | 4/1973 | Gildemeister . |
| 3,801,098 | 4/1974 | Gildemeister . |
| 3,811,596 | 5/1974 | Wilson . |
| 3,830,496 | 8/1974 | Reizer . |
| 3,841,130 | 10/1974 | Scott, Jr. et al. . |
| 3,861,682 | 1/1975 | Fujii . |
| 3,876,204 | 4/1975 | Moore et al. . |
| 3,963,239 | 6/1976 | Fujii . |
| 4,056,267 | 11/1977 | Krieger . |
| 4,241,919 | 12/1980 | Foreman . |
| 4,600,193 | 7/1986 | Merritt . |
| 4,744,136 | 5/1988 | Foreman et al. . |
| 4,951,948 | 8/1990 | Peng . |
| 5,219,164 | 6/1993 | Peng . |
| 5,393,055 | 2/1995 | MacKay, Jr. . |
| 5,415,398 | 5/1995 | Eggiman . |
| 5,421,572 | 6/1995 | MacKay, Jr. . |
| 5,458,330 | 10/1995 | Baum . |
| 5,494,280 | 2/1996 | MacKay, Jr. . |
| 5,511,777 | 4/1996 | McNeely . |
| 5,785,614 | 7/1998 | MacKay, Jr. ..... 473/566 |

FOREIGN PATENT DOCUMENTS

| | | |
|---|---|---|
| 962291 | 2/1975 | Canada . |

*Primary Examiner*—Mark S. Graham
*Attorney, Agent, or Firm*—Klarquist Sparkman; Campbell Leigh & Whinston, LLP

[57] ABSTRACT

An end plug for a tubular bat includes a rigid plug member that forms the closure of the barrel portion of the bat. The plug member has radial supports formed thereon. The end plug further includes a rigid reinforcing member that cooperatively interconnects with the plug member to reinforce the supports formed thereon. A resilient member supports the plug member and the reinforcing member within the barrel portion of the bat. A method of forming and installing an end plug includes interconnecting a plug member and a reinforcing member such that the reinforcing member reinforces supports formed on the plug member. The plug member and the reinforcing member are then positioned within the opening of the barrel portion so that the plug member forms a closure of the barrel portion. Liquid material is poured into the handle end of the bat and allowed to drain through the frame of the bat until it rests on the plug member. The liquid material then solidifies to form a support member.

22 Claims, 2 Drawing Sheets

BAT END PLUG AND METHOD FOR MAKING THE SAME

FIELD OF THE INVENTION

The present invention pertains to ball bats, such as baseball and softball bats and more particularly to an end plug for such bats.

BACKGROUND OF THE INVENTION

Tubular metallic bats, including those used for baseball, are known in the art. Such bats typically have a barrel portion that tapers down to a narrow handle. A familiar example is a tubular aluminum bat. Such bats have the advantage of generally good impact response, meaning the bat effectively transfers energy to a batted ball. This effective energy transfer results in ball players achieving good "slugging" distances with batted balls. Those who are familiar with the art commonly refer to bats that allow the hitter to achieve good slugging distances as "lively" bats.

Although today's aluminum bats perform well, there is a continuing quest for more lively bats. Accordingly, one important need is to optimize the impact response of a bat. This quest has produced tubular bats using other materials, such as titanium. Titanium bats perform well, but the material cost and difficulty of working titanium result in a high consumer cost.

In many metallic bats, a knob attaches to the handle end of the bat and an end plug fits into the barrel end of the bat. End plugs have served a variety of purposes in the attempt to achieve a more lively bat. End plugs have operated as structural members to keep bats circular when forces act on the bat, such as when hitting a ball. End plugs also have been used to shift the center of mass to reduce the bat's moment of inertia, allowing greater bat speed, or move the center of mass closer to the optimum impact area of the barrel portion. Other end plugs have added weight to the end of the barrel portion to increase the moment of inertia.

Prior end plugs have not provided sufficient structural support in bat applications where large forces are produced within the bat, such as baseball bats and fast pitch softball bats. Many such end plugs are made entirely of resilient material. As a result, when bats having such end plugs are impacted near the end of the bat, the bats are allowed to deflect sufficiently to permanently deform the bat.

Some prior bats have included metallic tubular inserts in the barrel portion to optimize the recovery of the bat in the area of the insert. U.S. Pat. No. 5,415,398 by Eggiman discloses an insert suspended within the barrel end of the bat. The end of the bat is crimped inwardly to hold the insert in place within the barrel portion. The insert disclosed by Eggiman was a significant advancement in the art. However, with such inserts, slight manufacturing variations in the insert or the frame may change the longitudinal position of the insert. This is especially true of bats, such as baseball bats, that are tapered along the barrel portion. If the longitudinal position of the insert is farther out of the barrel portion than is specified by the design, the barrel portion receives less support from the insert and is more prone to plastic deformation (such as dents). Moreover, if the insert is positioned farther within the barrel portion than is specified by the design, the fit between the crimped end and the insert may not be sufficiently tight.

SUMMARY OF THE INVENTION

The present invention overcomes the above identified problems with prior ball bat end plugs. The present invention provides an improved tubular bat end plug forming a closure of the barrel portion. More specifically, the end plug includes a rigid plug member that forms the closure of the barrel portion and a resilient support member that supports the plug member within the barrel portion, thus coupling the end plug to the barrel portion. The end plug provides structural support to the end of the bat, and is able to withstand large impact forces, such as those produced in baseball bats. The end plug also enhances the impact response of the bat.

In one embodiment of the invention, the plug member has radial supports formed thereon, and the end plug includes a rigid reinforcing member that cooperatively interconnects with the plug member to reinforce the supports formed thereon. The resilient member then supports the plug member and the reinforcing member within the barrel portion of the bat. The reinforced supports provide added structural integrity to the end plug system, allowing it to withstand the stresses caused by repeated impacts. A tubular insert is disposed within the barrel portion, and is supported on one end by the resilient member. The insert improves the impact response of the bat by allowing the barrel portion of the bat to undergo sufficient elastic deflection, but not allowing the barrel portion to plastically deform. The resilient member provides a sufficiently tight fit with the insert without weakening the insert by imposing undue forces on it.

The invention also provides a method of forming and installing an end plug. The method includes interconnecting a plug member and a reinforcing member such that the reinforcing member reinforces supports formed on the plug member. The plug member and the reinforcing member are then positioned within the opening of the barrel portion so that the plug member forms a closure of the barrel portion. Liquid material is poured into the handle end of the bat and allowed to drain through the frame of the bat until it rests on the plug member. The liquid material then solidifies to form a support member.

DESCRIPTION OF PREFERRED EMBODIMENT

The present invention preferably is used with aluminum bats, but the invention is also effective with other tubular bats, such as carbon composite or titanium bats. Also, the present invention is preferably used with baseball bats, but the invention may also be used in other bats, such as softball bats, with advantageous results. Although the present invention may be used in both single wall and double wall bat applications, it is particularly well-suited for use in those applications where the bat barrel end is subject to relatively large forces and can benefit from added structural support.

Figure 2:
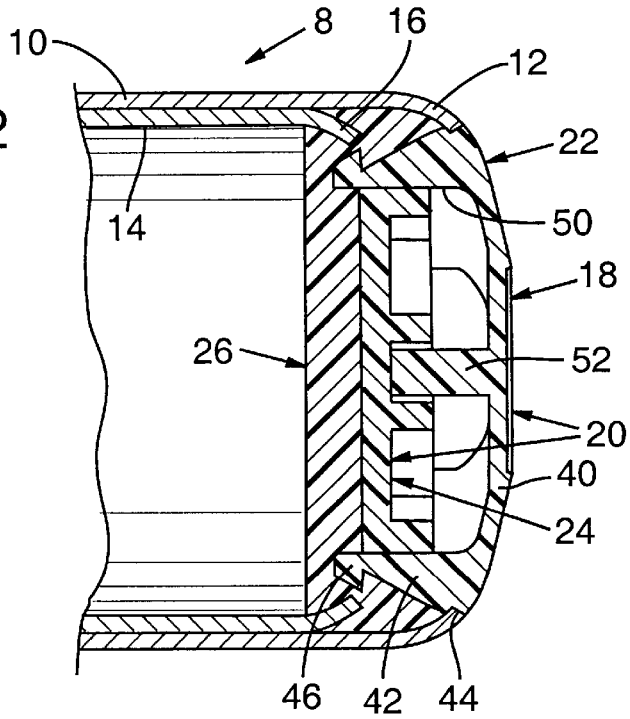
FIG. 2 is a side sectional view of a bat end including the end plug according to a preferred embodiment of the present invention.
Figure 3:
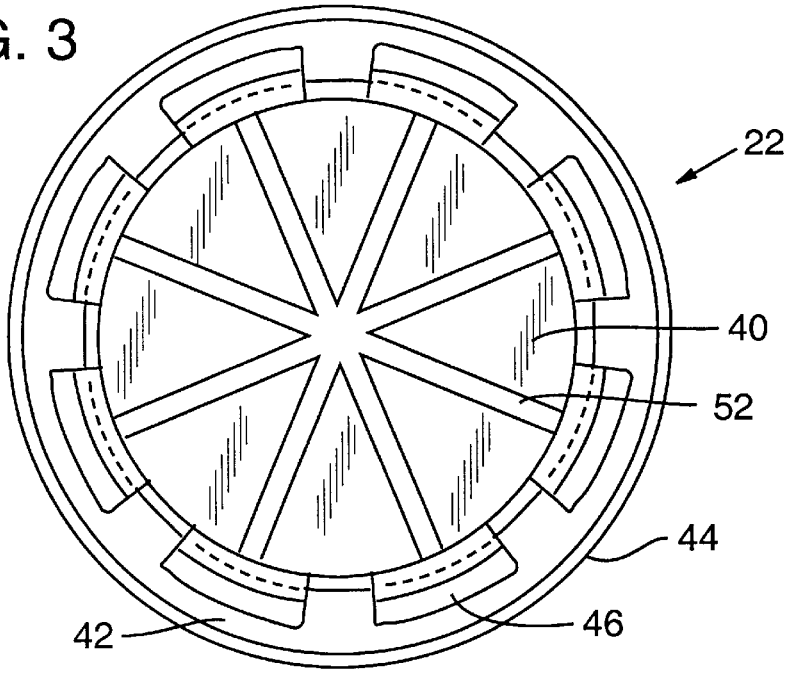
FIG. 3 is a bottom view of the end plug according to a preferred embodiment of the present invention.

Referring now to FIG. 2, a typical tubular bat includes a frame 8 having a large diameter barrel portion 10 and an intermediate portion (not shown) that tapers down to a small diameter handle portion. The barrel portion 10 may be of a constant diameter or may taper slightly toward the handle end of the bat. In a preferred embodiment, an end 12 of the barrel portion 10 preferably is crimped inwardly. A tubular insert 14 is disposed within the barrel portion 10. A first end 16 of the tubular insert 14 is preferably crimped inwardly. However, the present invention will also produce advantageous results with an insert that is not crimped inwardly at its end.

In a preferred embodiment of the present invention, a gap (not shown) exists between the barrel portion 10 and the insert 14, as disclosed in U.S. Pat. No. 5,415,398. The gap allows the barrel portion 10 to undergo some elastic deflection before contacting the insert 14. A lubricant preferably is disposed within the gap to promote free movement between the insert 14 and the barrel portion 10. However, the lubricant may be omitted if the insert 14 will move freely within the barrel portion 10 even without the lubricant. The size of the gap will vary depending on the size and type of bat. In some applications, the gap is very small, or alternatively there may be no gap, as long as the insert 14 and the barrel portion 10 are able to move independent of each other upon impact. This independent movement allows the insert 14 to act substantially as a leaf spring upon impact. In applications where a larger gap is present, it is often advantageous for the barrel portion 10 to be thinner so that the frame 8 will deflect across the gap to transfer a sufficient portion of the impact load to the insert 14.

An end plug 18 forms a closure of the barrel portion 10. The end plug 18 preferably includes a relatively rigid assembly 20 (best seen in FIG. 1) and a resilient supporting member 26 which cooperatively engages the rigid assembly to secure it in place. The assembly 20 in turn includes a plug member 22 that closes the end 12 of the barrel portion 10 and a reinforcing member 24 coupled to the plug member to reinforce it. The supporting member 26 serves to dampen vibrations caused by ball impacts and to secure in place the assembly 20, second end 16 of the insert 14, and barrel end 12 relative to one another. More specifically, the supporting member 26 and assembly 20 mutually support each other and cooperate with the insert end 16 and barrel end 12, such that the insert 14 and end plug 18 do not move longitudinally.

Figure 1:
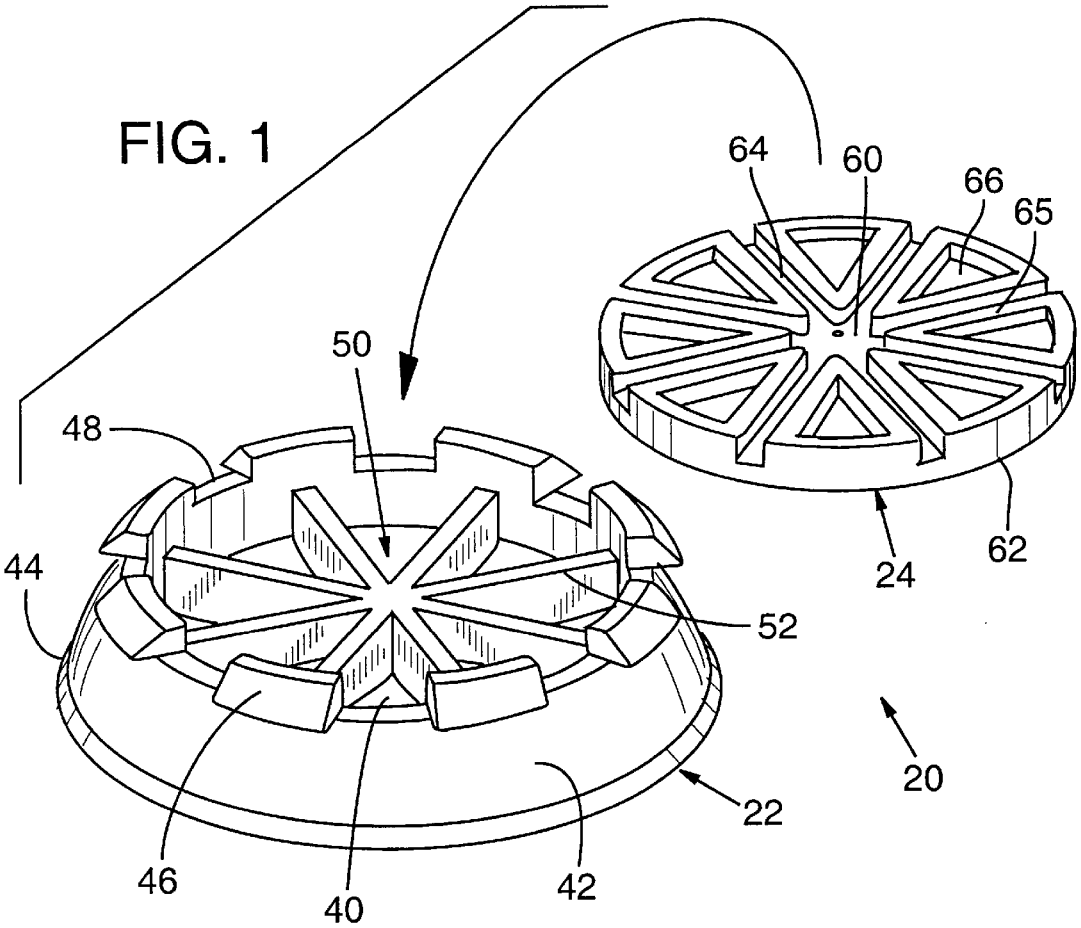
FIG. 1 is an exploded perspective view of the plug member and the reinforcing member according to a preferred embodiment of the present invention.

As shown in FIG. 2, the plug member 22 preferably includes a radial wall 40 and a circumferential wall 42 that extends axially from the periphery of the radial wall 40. The radial wall 40 preferably is slightly convex in shape, although it also may be substantially flat or slightly concave. The circumferential wall 42 preferably is substantially frustro-conical in shape, and has a large diameter portion adjacent the radial wall 40. The plug member 22 defines an annular groove 44 that extends around the periphery of the radial wall 40. The groove 44 is located at the interface between the circumferential wall 42 and radial wall 40. The groove 44 is configured to cooperatively receive the crimped end 12 of the barrel portion 10. The diameter of the groove 44 is such that the plug member 20 snaps into place on the crimped end. The tapered end of the circumferential wall 42 is provided with integral, circumferentially spaced tabs 46 which extend axially away, and radially outwardly, from the tapered end to define channels 48 (FIG. 1).

The radial wall 40 and circumferential wall 42 define a bore 50. The bore 50 preferably has a substantially constant diameter. The bore 50 is spanned by radial spoke-like supports or braces 52. In a preferred embodiment, the supports 52 are columnar members having a substantially rectangular cross section. The radial supports 52 extend radially inwardly from the circumferential wall 42, converging and then integrally joining one another at a central hub to provide an interconnected supporting frame for the plug member 22 and end plug as a whole. However, it should be appreciated that the supports can have various shapes. Moreover, those skilled in the art will appreciate that the shape of the plug member may differ from that described above as long as it closes the end of the barrel portion and is sufficiently stiff and strong to withstand repeated impacts.

Figure 4:
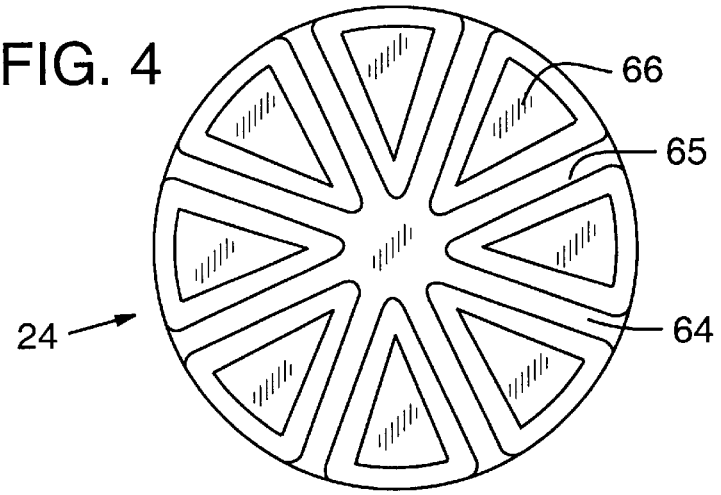
FIG. 4 is a top view of the of the support member according to a preferred embodiment of the present invention.
Figure 5:
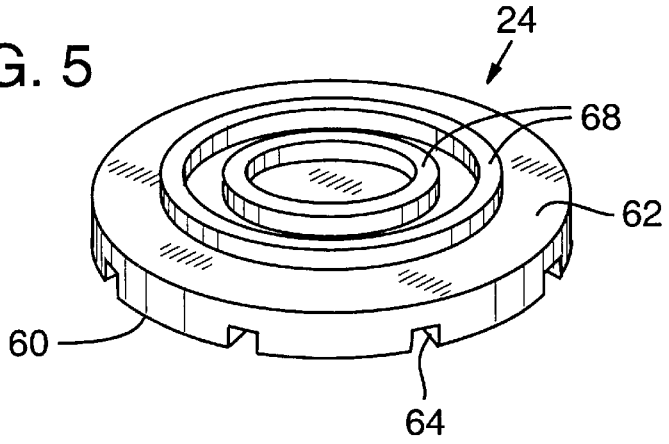
FIG. 5 is a perspective view of the support member of FIG. 4.

Referring now to FIGS. 4–5, the reinforcing member 24 preferably forms a disk having a first side 60 and an opposed second side 62. It has an outer diameter sized to allow the reinforcing member to fit snugly within the bore 50 of the plug member 22. Referring to FIG. 4, the first side 60 of the reinforcing member 24 defines radially extending channels 64 that are adapted to receive the supports 52 of the plug member 22. The channels preferably are formed by raised pie-shaped members 65 which are circumferentially spaced from one another. The apices of the pie-shaped members stop short of the center to provide clearance for the hub which interconnects the supports 52. In a preferred embodiment, each pie-shaped member 65 has an internal recess 66 to decrease the amount of material required to construct the reinforcing member 24, while allowing the reinforcing member to retain its strength. Referring now to FIG. 5, concentric annular ridges 68 are formed on the second side 62 of the reinforcing member 24. The ridges 68 support the reinforcing member 24 to prevent buckling.

Referring back to FIG. 1, the reinforcing member 24 interconnects or mates with the plug member 22 to form the rigid assembly 20. The plug member 22 is positioned such that the annular groove 44 receives the barrel end 12 and the circumferential wall 42 extends axially inside the barrel portion 10. The reinforcing member 24 is seated within the bore 50 of the plug member 22 with the first side 60 facing toward the radial wall 40 of the plug member. The channels 64 receive the supports 52 to reinforce the supports and prevent buckling.

As shown in FIG. 2, the resilient supporting member 26 encases the circumferential wall 42 of the plug member 22, second side 62 of the reinforcing member 24, tabs 46, and crimped second end 16 of the insert 14. The supporting member 26 also bears against the inner bore wall of the crimped end 12, thereby securely interconnecting and locking the end plug 18 and insert end 16 in place within the barrel portion. The supporting member 26 preferably has a side facing axially into the barrel portion 10 that is substantially planar. The remainder of the surface of the supporting member 26 is defined by its interface with the plug member 22, reinforcing member 24, insert 14 and barrel portion 10.

The insert 14 has a second end (not shown) opposite the first end, which preferably is secured to the frame 8 of the bat by an interference fit with a tapering portion of the barrel 10 or, alternatively, with the intermediate tapering portion of the bat. The first insert end 16 is supportively secured to the barrel portion 10 by the supporting member 26. The supporting member 26 is in turn supported within the barrel portion 10 of the bat.

Preferably, the reinforcing member 24 and the plug member 22 are formed from a rigid polymer with good toughness characteristics. Parts made of polymers often have weld lines where separate streams of liquid polymer come together within a mold. These weld lines are often weak because the separate streams do not bond well to each other. Thus, the preferred material is one which bonds well to itself, even in areas such as weld lines, such as nylon six with tougheners. Alternatively, the material may be some other rigid polymeric material, or another type of rigid material that is not a polymer.

The supporting member 26 preferably is made of a material that has a good balance of damping and resiliency characteristics, and is easily castable. In a preferred embodiment, the material is urethane. Alternatively, the material may be some other type of elastomeric material that has good resiliency and damping characteristics.

In one alternative embodiment of the present invention, the reinforcing member may be omitted. Such an embodiment may be advantageous in those applications where the forces on the bat are not as great, such as with small baseball bats. Preferably, in this embodiment, a thin disk-shaped dam is seated within the bore of the plug member so that in the manufacturing process the liquid material used to form the supporting member does not fill the entire bore of the plug member. This is helpful to decrease the necessary material, and thus the necessary weight of the supporting member. The dam is preferably a lightweight material, such as paper.

The stiffness of the end plug also can be optimized for different applications by using different materials having different properties (hardness and strength, for example), including different grades of plastic or urethane. It will be appreciated, however, that the present invention is best suited for those applications demanding a relatively hard, stiff end cap, as distinguished from a soft, pliable end cap.

The process of making a bat having the end plug of the present invention will now be described. A bat shell, open at both ends, having a barrel portion, handle portion and tapering intermediate portion therebetween is formed in a conventional manner. A tubular insert, preferably having an outer layer of grease and a crimped end is inserted in the open end of the barrel portion, again in a conventional manner. The end of the barrel portion then is crimped.

The reinforcing member 24 and plug member 22 are matingly coupled together as described above to form the assembly 20. The assembly 20 is inserted into the open end 12 of the barrel portion 10 with the small diameter portion of the circumferential wall 42 extending into the barrel portion 10. As the end plug is forced axially into the barrel portion, the end 12 of the barrel portion snaps into the annular groove 44 to secure the assembly 20 within the barrel portion.

The bat is then oriented vertically with the opening of the handle portion facing upwardly. Liquid material such as urethane is poured into the open handle end and runs downwardly through the bat. The interface between the assembly 20 and barrel end 12 forms a dam-like seal to prevent the liquid material from exiting the end of the barrel portion. The liquid material flows through the channels 48 defined by the plug member 22 and fills the empty space surrounding the assembly 20. Preferably, the reinforcing member 24 prevents the liquid material from entering the bore 50 of the plug member 22 to minimize the required amount of liquid material. A sufficient amount of liquid should be used so that the insert end 16 is immersed in the liquid. The liquid material then solidifies to form the supporting member 26, and the open surface of the liquid forms the substantially planar side of supporting member.

It has been found that about 0.75 ounces of liquid urethane works well, although it will be appreciated that the amount of material used may be influenced by design parameters suitable for the particular bat model and its intended application. A bat designed for "Little League" baseball necessarily would have different specifications than one designed for competitive college baseball. For example, if desirable, the end weight of the bat can be increased by using additional liquid material.

The end plug 18 is particularly advantageous in applications where the bat is subject to large stresses, such as competitive baseball. The assembly 20 is rigid enough to support the barrel portion 10 and prevent plastic deformation. The supports 52 on the plug member 22 provide strength to the assembly 20 in the radial direction, and the reinforcing member reinforces those supports to prevent buckling, so that the assembly is rigid and strong. Moreover, the supporting member 26 is disposed around the tabs 46, so that the supporting member will hold the assembly 20 in place within the barrel portion 10 even after repeated impacts. The balance of damping and resiliency characteristics in the supporting member 26 also enhances the bat's impact response.

In an embodiment wherein a tubular insert 14 is disposed within the barrel portion 10 of the bat, the supporting member 26 supports the insert without imposing undue stresses on it. This is true even if the longitudinal position of the insert 14 varies relative to the barrel portion 10 because of inconsistencies in the dimensions of the frame 8 or the insert 14, since the supporting member 26 is formed around the insert after the insert has been inserted within the frame 8.

Although the invention has been described with reference to specific embodiments, it should be apparent to those of ordinary skill in the art that the arrangement and details disclosed herein may be modified without departing from the spirit and scope of the invention.

Therefore, I claim all such modifications as fall within the scope and spirit of the following claims and all equivalents thereto:

What is claimed is:

1. A bat end, comprising:

a tubular barrel portion;

a tubular insert positioned within the barrel portion;

a rigid plug member forming a closure of the barrel portion; and a resilient supporting member in supportive engagement with the barrel portion, insert and plug member.

2. The bat end of claim 1, wherein the plug member includes plural supports.

3. The bat end of claim 2, further including a rigid reinforcing member defining grooves that are adapted to cooperatively receive the supports.

4. The bat end of claim 3, wherein the reinforcing member is substantially disk-shaped and has grooves formed in one side of the reinforcing member.

5. The bat end of claim 4, wherein at least one ridge is formed in the reinforcing member on a side opposite the grooves.

6. The bat end of claim 2, wherein the supports extend radially.

7. The bat end of claim 1, wherein the plug member has a substantially frustro-conical shape.

8. The bat end of claim 1, wherein the plug member defines tabs extending into the supporting member for engagement therewith.

9. The bat end of claim 1, wherein the plug member defines an annular groove adapted to receive an end of the barrel portion.

10. A bat end plug, comprising:

a rigid plug member capable of forming a closure of a hollow bat barrel portion, and having supports formed thereon; and a rigid reinforcing member cooperatively engaging the plug member to reinforce the supports; and a resilient support member which substantially encases and supports the plug member and the reinforcing member.

11. The end plug of claim 10, wherein the reinforcing member has a first side which defines grooves that cooperatively receive the supports.

12. The end plug of claim 10, wherein the reinforcing member is substantially disk-shaped.

13. The end plug of claim 11, wherein the reinforcing member has a second side opposite the first side, which defines at least one annular ridge.

14. The end plug of claim 10, wherein the supports extend radially.

15. The end plug of claim 10, wherein the plug member forms a substantially frustro-conical shape.

16. The end plug of claim 15, wherein the plug has a large diameter portion which defines an annular groove capable of receiving a bat barrel end portion, and a smaller diameter portion which extends axially from the large diameter portion.

17. The end plug of claim 16, wherein the plug member defines tabs extending outwardly from the small diameter portion for engagement with the resilient member.

18. A bat, comprising:

a tubular frame having an enlarged barrel portion at one end;

a tubular insert supported within the barrel portion;

a substantially frustro-conical rigid plug member forming a closure of the barrel portion, the plug member defining a bore and including radial supports spanning the bore and outwardly extending tabs;

a substantially rigid disk-shaped reinforcing member positioned within the bore and forming channels to cooperatively receive the supports; and a resilient support member which supportively engages the plug member, tabs, reinforcing member, and insert, the resilient support member being supported within the barrel portion.

19. The bat of claim 18, wherein the plug member includes a radial wall and a circumferential wall extending from the periphery of the radial wall, the plug member defining an annular groove around the periphery of the radial wall to receive an end of the barrel portion.

20. A method of forming a bat end plug, comprising:

providing a tubular bat frame having a barrel portion and a handle portion;

placing a tubular insert within the barrel portion;

providing a rigid plug member having supports formed thereon;

coupling a substantially rigid reinforcing member to the plug member to form an assembly, such that the reinforcing member supportively engages the supports;

inserting the assembly into the barrel portion to form a closure of the barrel portion;

pouring a liquid material into the handle portion and allowing it to run through the frame until it rests on the plug member; and allowing the liquid material to solidify around the assembly.

21. The method of claim 16, wherein the liquid material becomes resilient when it solidifies.

22. The method of claim 17, wherein the liquid material is urethane.

* * * * *